US006931863B2

(12) United States Patent
Chen et al.

(10) Patent No.: US 6,931,863 B2
(45) Date of Patent: Aug. 23, 2005

(54) STIRLING REFRIGERATOR

(75) Inventors: Wei Chen, Nara (JP); Masaaki Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 22 days.

(21) Appl. No.: 10/362,194

(22) PCT Filed: Aug. 13, 2001

(86) PCT No.: PCT/JP01/06993

§ 371 (c)(1),
(2), (4) Date: Feb. 21, 2003

(87) PCT Pub. No.: WO02/16842

PCT Pub. Date: Feb. 28, 2002

(65) Prior Publication Data

US 2004/0089012 A1 May 13, 2004

(30) Foreign Application Priority Data

Aug. 22, 2000 (JP) ..... 2000-250854
Feb. 22, 2001 (JP) ..... 2001-47143

(51) Int. Cl.[7] ..... F25B 9/00; F25B 47/00
(52) U.S. Cl. ..... 62/6; 62/277
(58) Field of Search ..... 62/6, 440, 441, 62/467, 277

(56) References Cited

U.S. PATENT DOCUMENTS 2,673,455 A * 3/1954 Brinkoeter ..... 62/277
4,280,334 A * 7/1981 Lakdawala ..... 62/277
5,277,035 A * 1/1994 Fristoe et al. ..... 62/277
5,586,441 A * 12/1996 Wilson et al. ..... 62/99
5,642,622 A * 7/1997 Berchowitz et al. ..... 62/6
5,979,172 A * 11/1999 Teller ..... 62/305

FOREIGN PATENT DOCUMENTS

| | | | |
|---|---|---|---|
| JP | 51-44351 A | | 4/1976 |
| JP | 59-212633 A | | 12/1984 |
| JP | 735463 A | * | 2/1995 |
| JP | 8-145522 A | | 6/1996 |
| JP | 2714155 B2 | | 10/1997 |
| JP | 10-332253 A | | 12/1998 |
| JP | 11-10010 A | | 1/1999 |
| JP | 2000-205614 A | | 7/2000 |
| JP | 2000-205682 A | | 7/2000 |

* cited by examiner

*Primary Examiner*—William C. Doerrler
(74) *Attorney, Agent, or Firm*—Birch, Stewart, Kolasch & Birch, LLP

(57) ABSTRACT

In a Stirling refrigerator, waste heat rejected from the heat rejecter of a Stirling refrigerating device is transferred by way of dew prevention heat pipes to heat the open side of the refrigerator. This makes it possible to prevent condensation of moisture on the open side of the refrigerator, where dew tends to collect as a door is opened or closed or in other situations, in an effective and energy-saving manner without using a heater, and thereby alleviate the load on the heat-rejecting heat exchanger.

11 Claims, 13 Drawing Sheets

STIRLING REFRIGERATOR

This application is the national phase under 35 U.S.C. § 371 of PCT International Application No. PCT/JP01/06993 which has an International filing date of Aug. 13, 2001, which designated the United States of America.

TECHNICAL FIELD

The present invention relates to a refrigerator provided with a Stirling refrigerating device.

BACKGROUND ART

Nowadays, household refrigerators and similar appliances generally adopt a vapor compression refrigerating cycle in which a CFC (chlorofluorocarbon)-based refrigerant is circulated. However, CFC-based refrigerants, when released into the atmosphere, reach the stratosphere without being decomposed, and destroy the ozone layer, constituting a much talked-about environmental problem. For this reason, production and use of conventionally widely used CFC-based refrigerants and alternatives thereto such as R-134a are becoming increasingly restricted worldwide.

Against this background, a reassessment has been made of the advantages of the thermodynamic cycle that has long been known as the reversed Stirling cycle, and in recent years much attention has been paid to Stirling refrigerating systems that exploit it. However, most Stirling refrigerating devices that have been put into practical use thus far are for use in comparatively small Stirling refrigerators with refrigeration performance of a few tens of watts or lower; that is, no Stirling refrigerating devices have ever been put into practical use that have refrigeration performance of the order of a few hundred watts, for which the highest demands are expected as models for household and commercial use.

Now, the conventional Stirling refrigerator disclosed in Japanese Patent Registered as No. 2714155 will be described. The refrigerator is provided with a Stirling refrigerating device, with a cold-side heat exchanger placed in a cold air passage formed in a rear portion of a refrigerating chamber of the refrigerator so as to allow circulation of cold air, and with a hot-side heat exchanger connected to a metal superficial portion of a body of the refrigerator.

When the Stirling refrigerating device is operated, cold is generated by the cold-side heat exchanger, and the cold air circulated through the cold passage cools the interior of the refrigerator. Moreover, an air-cooling fan is provided in a V-shaped heat rejection passage formed at the back of the cold air passage so that the heat accumulated in the hot-side heat exchanger is actively rejected out of the refrigerator. Furthermore, part of the heat rejected from the hot-side heat exchanger is rejected out of the refrigerator also by way of the metal superficial portion of the refrigerator body. This alleviates the load on the hot-side heat exchanger and thereby enhances heat rejection efficiency.

This conventional refrigerator is built as a system in which cooling is achieved by discharging cold as sensible heat directly into the refrigerator by using air as a medium. Accordingly, to obtain refrigeration performance of the same order as achieved with this conventional vapor compression refrigerating cycle exploiting sensible heat, it is necessary to use large heat exchangers, making the system bulky. Thus, with this conventional construction, it is difficult to achieve satisfactory miniaturization and cost reduction required in systems for household use.

The biggest stumbling block is miniaturization of the refrigerating system. In particular, to secure storage space comparable with that permitted by the conventional vapor compression refrigerating cycle, it is essential to miniaturize the Stirling refrigerating device itself In recent years, miniaturization of Stirling refrigerating devices has been studied eagerly. As Stirling refrigerating devices are made increasingly compact, their heat rejecters and heat absorbers are made increasingly small, and the spaces inside their cylinders, filled with a working medium such as helium, are made increasingly small.

Accordingly, to obtain a large quantity of cold efficiently from a miniaturized Stirling refrigerating device, it is necessary to increase the heat exchange efficiency of the heat exchangers attached to its heat rejecter and heat absorber. As a result, despite the miniaturization of the Stirling refrigerating device itself, the heat exchangers attached thereto are now larger. This hinders satisfactory miniaturization of the refrigerating system as a whole.

Therefore, to realize a space-saving refrigerating system with desired refrigeration performance, it is very important, in addition to miniaturizing the Stirling refrigerating device itself, to miniaturize the heat exchangers while maintaining their heat exchange efficiency.

Incidentally, in a conventional medium-size household refrigerator exploiting the conventional vapor compression refrigerating cycle, piping for heat rejection, as long as about 20 m including a condenser, is laid in a serpentine layout. Here, heat exchange is achieved by exploiting both the sensible heat of the refrigerant circulated through that piping and the latent heat resulting from condensation.

By contrast, in the conventional Stirling refrigerator disclosed in the Japanese Patent mentioned above, forced air-cooling is proposed, which is considered to require an extremely large heat exchanger for heat rejection. Thus, to achieve satisfactory heat rejection from the heat-rejecting heat exchanger, it is necessary to increase the amount of cooling air blown onto the heat-rejecting heat exchanger. Increasing the amount of cooling air, however, results in increasing the electric power consumption of the blower fan. This means that extra electric power consumption degrades the efficiency of the system as a whole.

Moreover, in this conventional Stirling refrigerator, the heat-rejecting head of the Stirling refrigerating device is connected to the metal superficial portion of the refrigerator body so that this portion plays a part in heat rejection and thereby alleviates the load of heat exchange on the heat-rejecting heat exchanger. However, considering the properties of the metal material used in the superficial portion of the body and the ambient conditions under which heat is rejected, the metal superficial portion exhibits high thermal resistance in the directions in which heat diffuses. Thus, the metal superficial portion contributes to effective heat rejection only in a portion thereof near the source of heat, i.e., near the heat-rejecting head. That is, the metal superficial portion has very little heat exchange effect, and thus contributes very little to the alleviation of the load on the heat-rejecting heat exchanger. This hinders satisfactory miniaturization of the heat-rejecting heat exchanger.

Moreover, to secure air-tightness inside the refrigerator, a door gasket made of flexible rubber or the like is laid along the edges of that side of the door which faces the interior of the refrigerator. As the door is opened or closed or in other situations, the cold air inside the refrigerator makes direct contact with the door gasket or the outer plate. This portion of the door thus tends to become especially cold as compared with the other portion thereof, and is therefore prone to collect dew resulting from condensation of moisture contained in outside air. When dew collects, it may drip to make the floor wet, or may produce rust in metal components.

To prevent this, it is common to embed a heater in the portion that is prone to collect dew so that the heater heats the portion to prevent dew from collecting. However, using a dew prevention heater results in extra electric power consumption unrelated to the operation of the refrigerating system, and is therefore disadvantageous in household refrigerators, which are expected to be low-priced and energy-saving.

On the other hand, drain water resulting from defrosting or the like of the interior of the refrigerator is collected in a drain pan. Since it is troublesome to periodically take out the drain pan to dispose of the collected water, it is customary to forcibly evaporate drain water by exploiting the heat generated by the condenser. This contributes to maintenance-free operation.

However, in a refrigerator exploiting the reversed Stirling cycle, there is provided no component that corresponds to a condenser, an integral part of the vapor compression refrigerating cycle. Thus, here, it is common to dispose of drain water by heating it with a heater. However, using a heater results in extra electric power consumption, inviting extra electricity charges, and is therefore uneconomical

DISCLOSURE OF THE INVENTION

An object of the present invention is to provide an energy-saving Stirling refrigerator with compact heat exchangers. Another object of the present invention is to provide a Stirling refrigerator free from collection of dew around the door gasket and free from maintenance of the drain pan for collecting drain water.

To achieve the above objects, according to one aspect of the present invention, in a Stirling refrigerator provided with a Stirling refrigerating device that includes a heat absorber for absorbing heat from outside air, a heat-absorbing heat exchanger for prompting heat absorption by the heat absorber, a heat rejecter for rejecting heat to outside, and a heat-rejecting heat exchanger for prompting heat rejection by the heat rejecter and that cools the interior of the refrigerator by absorbing heat through the heat absorber by a process of the reversed Stirling cycle, dew prevention heat pipes are, at one end, thermally coupled to the heat rejecter and are, at the other end, located at the open side of the refrigerator so that, as the Stirling refrigerating device is operated, waste heat rejected from the heat rejecter is transferred by way of the dew prevention heat pipes to heat the open side of the refrigerator.

In this construction, waste heat rejected from the heat rejecter is transferred by way of the dew prevention heat pipes to heat the open side of the refrigerator. This prevents condensation of moisture in this portion of the refrigerator.

Moreover, a ring-shaped member made of a material with high thermal conductivity may be fitted around the heat rejecter, with a plurality of small holes formed in an end surface of the ring-shaped member to permit the dew prevention heat pipes to be, at one end, inserted into them so as to be coupled to the ring-shaped member. This makes easier the transfer, by way of the dew prevention heat pipes, of waste heat rejected from the heat rejecter.

According to another aspect of the present invention, in a Stirling refrigerator provided with a Stirling refrigerating device that includes a heat absorber for absorbing heat from outside air, a heat-absorbing heat exchanger for prompting heat absorption by the heat absorber, and a heat rejecter for rejecting heat to outside and that cools the interior of the refrigerator by absorbing heat through the heat absorber by a process of the reversed Stirling cycle, and a drain collection pan for collecting drain water resulting from defrosting of the refrigerator interior and the heat-absorbing heat exchanger, drain evaporation heat pipes are, at one end, thermally coupled to the heat rejecter and are, at the other end, located above the drain collection pan so that, as the Stirling refrigerating device is operated, waste heat rejected from the heat rejecter is transferred by way of the drain evaporation heat pipes to heat the drain water.

In this construction, waste heat rejected from the heat rejecter is transferred by way of the drain evaporation heat pipes to heat the drain water collected in the drain collection pan as a result of defrosting and the like of the refrigerator interior.

Here, a plurality of flat-plate fins extending in opposite directions may be fitted to the drain evaporation heat pipes. This prompts heat rejection from the heat rejecter. In this case, among the plurality of flat-plate fins, those located at predetermined regular intervals may be made longer than the others so as to make contact with the drain water. This reduces resistance to the air passing between the fins. Furthermore, grooves having a capillary effect may be formed in the surfaces of the flat-plate fins, or the surfaces of the flat-plate fins may be treated by blackening. This permits drain water to rise to the surfaces of the flat-plate fins and evaporate from a wide area.

Moreover, a ring-shaped member made of a material with high thermal conductivity may be fitted around the heat rejecter, with a plurality of small holes formed in an end surface of the ring-shaped member to permit the drain evaporation heat pipes to be, at one end, inserted into them so as to be coupled to the ring-shaped member. This makes easier the transfer, by way of the drain evaporation heat pipes, of waste heat rejected from the heat rejecter.

According to another aspect of the present invention, in a Stirling refrigerator provided with a Stirling refrigerator device that includes a heat absorber for absorbing heat from outside air, a heat-absorbing heat exchanger for prompting heat absorption by the heat absorber, a heat rejecter for rejecting heat to outside, and a heat-rejecting heat exchanger for prompting heat rejection by the heat rejecter and that cools the interior of the refrigerator by absorbing heat through the heat absorber by a process of the reversed Stirling cycle, and a drain collection pan for collecting drain water resulting from defrosting of the refrigerator interior and the heat-absorbing heat exchanger, Here, a plurality of flat-plate fins may be fitted to the portion of the drain evaporation heat pipes located inside the drain collection pan. This prompts heat rejection from the heat rejecter.

drain evaporation heat pipes are, at one end, thermally coupled to the heat rejecter and are, at another end, located inside the drain collection pan so that, as the Stirling refrigerating device is operated, waste heat rejected from the heat rejecter is transferred by way of the drain evaporation heat pipes to the heat drain water.

In this case, a water level detection sensor may be provided inside the drain collection pan to check whether there is drain water in the drain collection pan or not so that, according to the result of detection by the water level detection sensor, the amount of air blown onto the heat-rejecting heat exchanger by an air-cooling fan is controlled. This permits the air-cooling fan to be operated with reduced electric power consumption according to the actual situation.

Alternatively, temperature sensors may be provided at both ends of the drain evaporation heat pipes to check whether transfer of heat is taking place by way of the drain evaporation heat pipes or not so that, according to the result of detection by the temperature sensors, the amount of air blown onto the heat-rejecting heat exchanger by an air-cooling fan is controlled.

According to another aspect of the present invention, in a Stirling refrigerator provided with a Stirling refrigerating device that includes a heat absorber for absorbing heat from outside air, a heat-absorbing heat exchanger for prompting heat absorption by the heat absorber, a heat rejecter for rejecting heat to outside, and a heat-rejecting heat exchanger for prompting heat rejection by the heat rejecter and that cools a to-be-cooled space by absorbing heat through the heat absorber by a process of the reversed Stirling cycle, a drain collection pan for collecting drain water resulting from defrosting of the refrigerator interior and the heat-absorbing heat exchanger, a drain evaporation pan for evaporating the drain water by using heat rejected from the heat-rejecting heat exchanger, a pipe for connecting the drain collection pan to the drain evaporation pan, and a pump for transferring the drain water collected in the drain collection pan by way of the pipe to the drain evaporation pan.

In this construction, the drain water collected in the drain collection pan is pumped up so as to be transferred by way of the pipe to the drain evaporation pan. The air around it is heated by the heat rejected from the heat-rejecting heat exchanger. This air is fed to the drain water in the drain evaporation pan, so that the drain water is evaporated quickly.

In this case, part of the pipe may be laid so as to make contact with the heat rejecter. This permits the drain water passing through the pipe to absorb part of the waste heat rejected from the heat rejecter and be thereby heated.

Here, a lid may be provided that hermetically closes the drain collection pan. This securely prevents dust from entering the drain collection pan. Thus, as drain water is pumped up, no dust enters the pump together therewith. This prevents failure or malfunctioning of the pump.

Moreover, ribs having a capillary effect may be formed on the bottom surface of the drain evaporation pan. This permits drain water to rise along the ribs, and thus permits it to evaporate quickly from a wide area on the surfaces of the ribs.

BEST MODE FOR CARRYING OUT THE INVENTION

Hereinafter, embodiments of the present invention will be described with reference to the drawings.

<First Embodiment>

Figure 1:
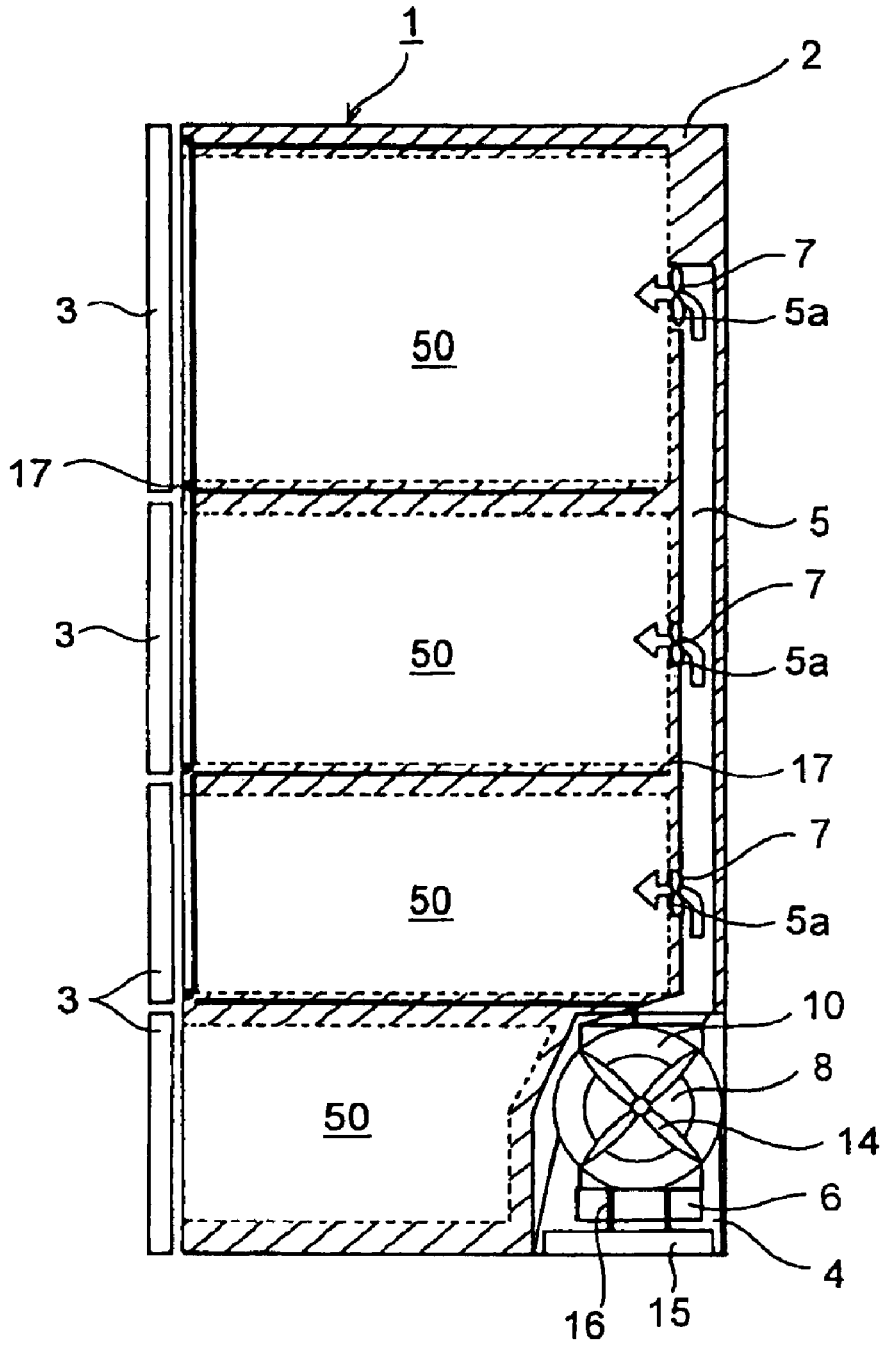
FIG. 1 is a schematic side sectional view of the refrigerator of a first embodiment of the invention.
Figure 2:
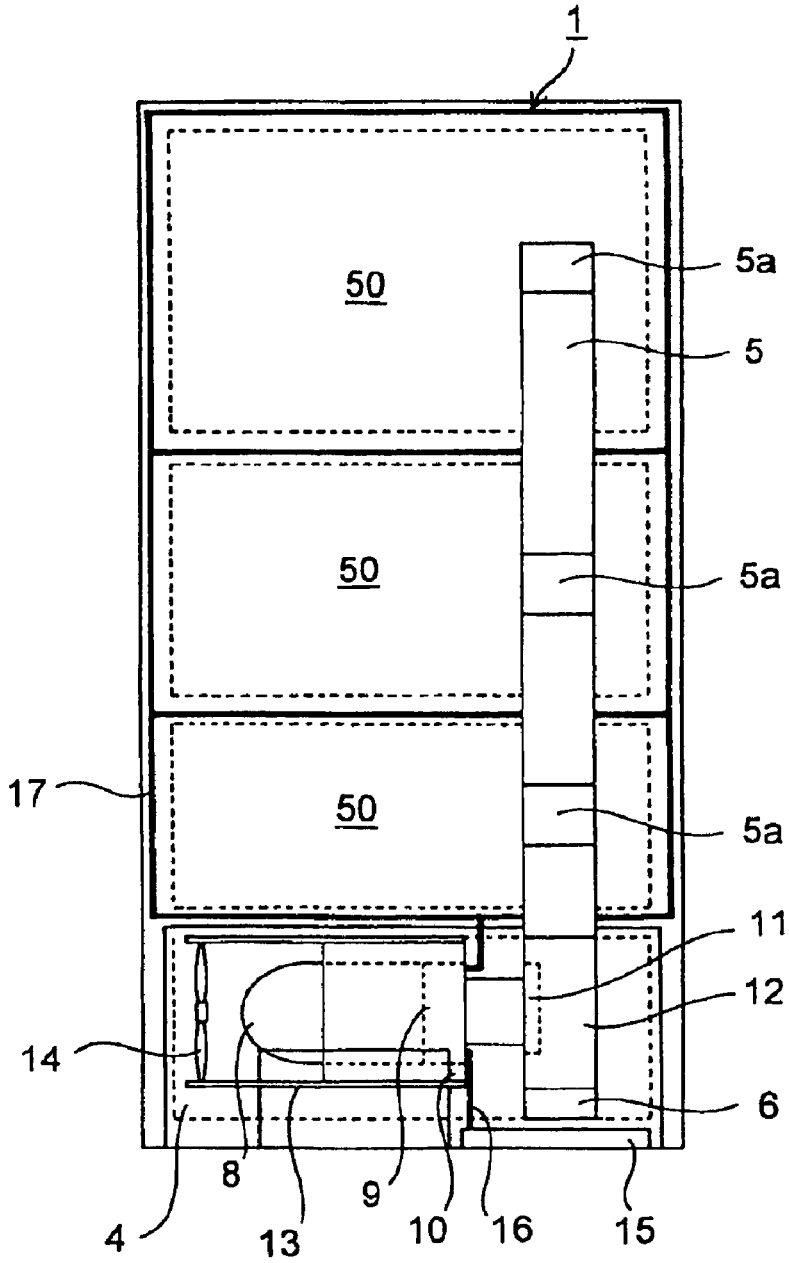
FIG. 2 is a back view of the refrigerator.

FIG. 1 is a side sectional view of the refrigerator of a first embodiment of the invention, and FIG. 2 is a back view of the refrigerator. In these figures, reference numeral 1 represents a body of the refrigerator, reference numeral 2 represents a heat-insulating material filling the gap between an inner case and an outer case of the body 1, reference numeral 3 represents heat-insulating doors for opening and closing openings in the front faces of storage compartments 50, and reference numeral 4 represents a machine compartment in which a refrigerating unit, described later, is housed.

A cold air duct 5 communicates with the storage compartments 50 through openings 5*a* formed in the rear faces thereof. Inside the cool air duct 5, near the openings 5*a*, cold air fans 7 for blowing cold air into the storage compartments 50 are provided. The cold air that has been circulated inside the storage compartments 50 by the cold air fans 7 returns by way of a return duct 6 to the cold air duct 5, and is blown onto a heat-absorbing heat exchanger 12 fitted to a cold head 11 of a Stirling refrigerating device 8. The cold air that thus has retrieved cold and is thereby cooled circulates again through the cool air duct 5 and enters the storage compartments 50 through the openings 5*a* to cool the interior of the storage compartments 50.

Figure 3:
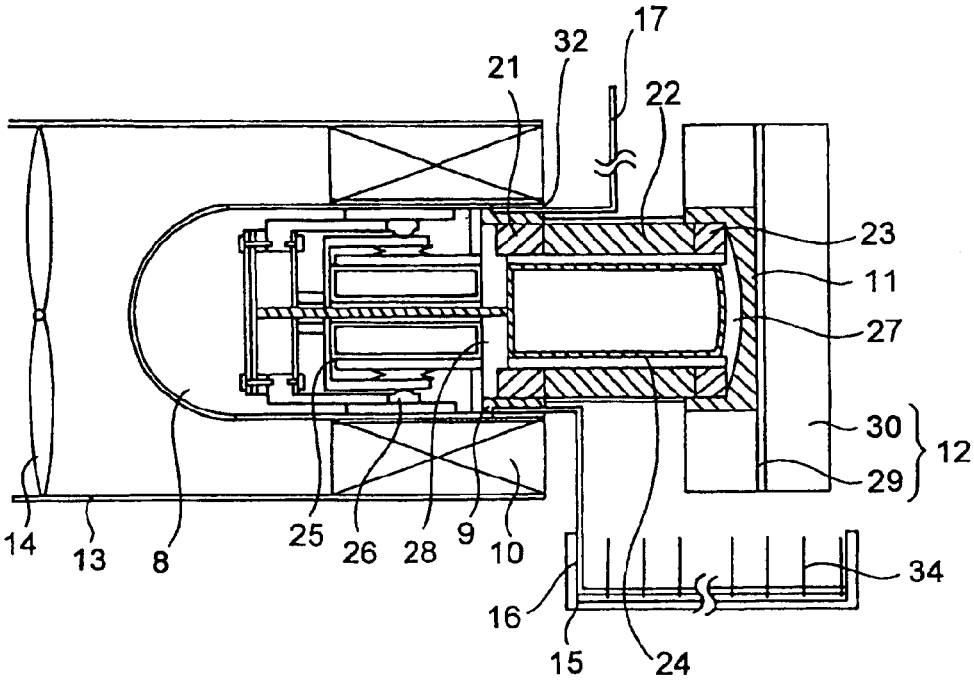
FIG. 3 is a sectional view of the refrigerating unit of the refrigerator.

The refrigerating unit is housed in the machine compartment 4 formed in a lowest, deepest portion of the refrigerator body 1. As shown in FIG. 3, the refrigerating unit includes a Stirling refrigerating device 8, a heat-rejecting heat exchanger 10 coupled to a warm head 9, a heat-absorbing heat exchanger 12 fitted to a cold head 11, a heat-rejecting heat exchange duct 13, an air-cooling fan 14, and a drain collection pan 15. Dew prevention heat pipes 17 are, at one end, thermally coupled to the warm head 9, and are, at the other end, located at the open side of the refrigerator body 1. Moreover, drain evaporation heat pipes 16 are, at one end, thermally coupled to the warm head 9, and are, at the other end, located inside the drain collection pan 15.

The Stirling refrigerating device 8 is composed of a displacer 24 for quickly expanding a working medium, such as helium sealed inside a cylinder, in an expansion space 27, a piston 25 for quickly compressing the working medium in a compression space 28, a linear motor 26 for driving the piston 25 to reciprocate, a heat-absorption-side internal heat exchanger 23 disposed in the expansion space 27, a heat-rejection-side internal heat exchanger 21 disposed in the compression space 28, and a heat-storing heat exchanger 22 placed between the heat-absorption-side internal heat exchanger 23 and the heat-rejection-side internal heat exchanger 21 so as to form a closed circuit through which the expansion space 27 and the compression space 28 communicate with each other.

In the Stirling refrigerating device 8 constructed as described above, when the linear motor 26 is operated, the displacer 24 and the piston 25, which are disposed coaxially, reciprocate with a fixed phase difference kept between them. The working medium compressed in the compression space 28 by the piston 25 is heated, and its heat is rejected through the warm head 9 from the heat-rejecting heat exchanger 10. The working medium then flows through the heat-storing heat exchanger 22 into the expansion space 27. The working medium expanded in the expansion space 27 by the displacer 24 returns through the heat-absorption-side internal heat exchanger 23 to the compression space 28, and meanwhile the working medium absorbs heat through the cold head 11 from the heat-absorbing heat exchanger 12. As a result, the return air that has returned from the storage compartments 50 (see FIG. 1) by way of the return duct 6 (see FIG. 1) is cooled.

The heat-absorbing heat exchanger 12 fitted to the cold head 11 is composed of a base portion 29 and a fin portion 30. This heat-absorbing heat exchanger 12 is used below the freezing point of water, and therefore, to prevent frosting, the fin portion 30 needs to be designed with a rather coarse fin pitch. Moreover, the space (in particular, the height thereof) inside the machine compartment 4, where the refrigerating unit is housed, is limited, and therefore the fin portion 30 cannot be designed to pile up high. Thus, it is advisable to secure the thermal conduction area of the heat-absorbing heat exchanger 12 in radial directions according to the desired heat exchange performance. However, as the fin portion 30 is extended in radial directions, it exhibits increasingly high thermal resistance the farther from the center where the cold head 11, the source of cold, is located.

Figure 4:
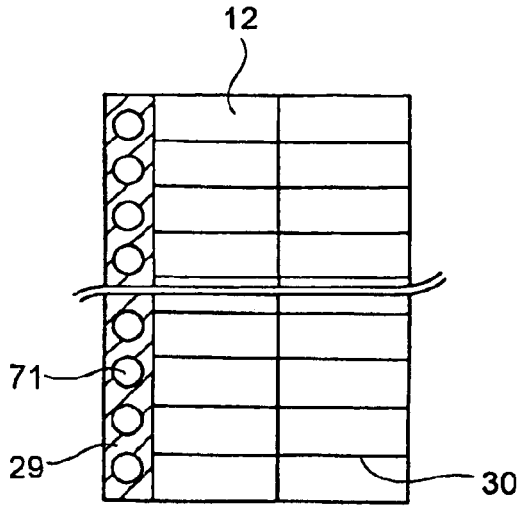
FIG. 4 is a sectional view of the of the heat-absorbing heat exchanger of the refrigerating unit.

To overcome this, as shown in FIG. 4, in the base portion 29, which is made of a material with high thermal conductivity, there are embedded heat pipes 71 having a refrigerant such as carbon dioxide or pentane sealed therein. This allows sufficient diffusion of cold by way of the heat pipes 71 to the end of the fin portion 30 away from the cold head 11, and thus helps achieve more uniform temperature distribution over the entire fin portion 30, leading to satisfactory heat exchange efficiency.

Figure 5A:
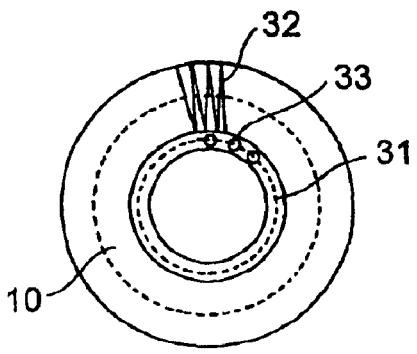
FIG. 5A is a front view of the heat-rejecting heat exchanger of the refrigerating unit.
Figure 5B:
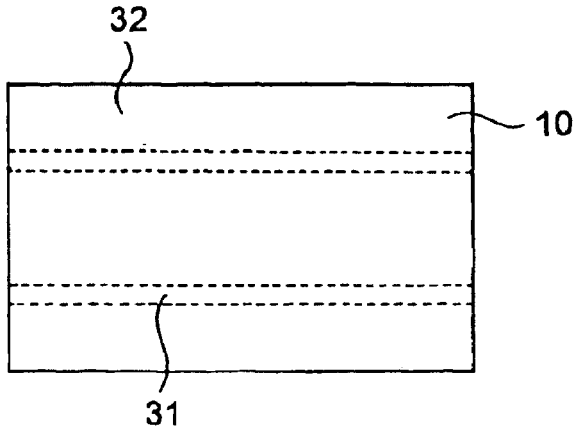
FIG. 5B is a side view of the heat-rejecting heat exchanger of the refrigerating unit.

On the other hand, as shown in a front view and a side view in FIGS. 5A and 5B respectively, the heat-rejecting heat exchanger 10 connected to the warm head 9 is ring-shaped, and is composed of a ring-shaped base 31 made of a high-thermal-conductivity material and having temperature-leveling heat pipes 33 embedded therein and a fin 32, such as a corrugate, louver, or flat-plate fin, fitted to the ring-shaped base 31 and having high thermal conductivity. The heat-rejecting heat exchanger 10 is disposed with one end thereof placed at one end of the warm head 9 so as to extend away from the heat-absorbing heat exchanger 12 in the axial direction. This permits the heat-rejecting heat exchanger 10 to have a satisfactorily wide thermal conduction area in radial directions. This, in combination with the miniaturization described above of the heat-absorbing heat exchanger 12, permits the Stirling refrigerating unit to be compactly housed in the machine compartment 4 while maintaining the refrigeration performance thereof.

Figure 6:
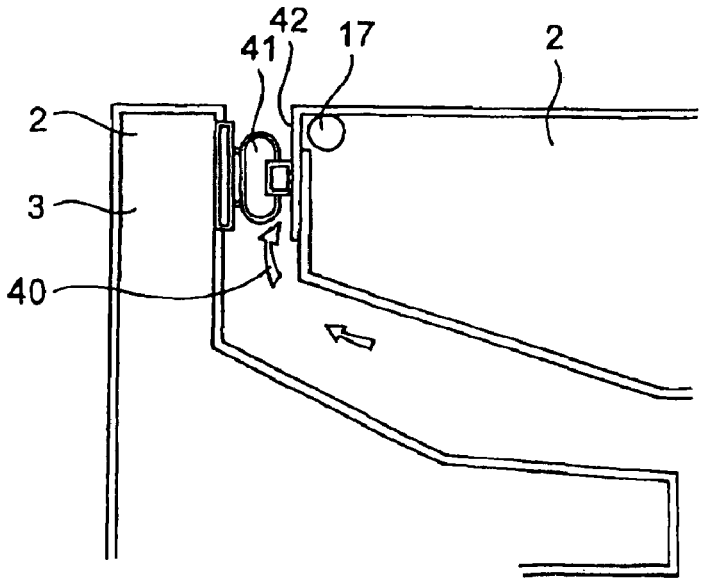
FIG. 6 is an enlarged sectional view of a principal portion of the refrigerator.

Incidentally, the air inside the refrigerator 1 is cooled to low temperatures, specifically to below −20° C. in a freezer compartment and to below 10° C. in a refrigerator compartment. Accordingly, to prevent the cool air 40 inside the refrigerator from leaking out and thereby maintain low temperatures, as shown in FIG. 6, along the edges of the inner side of each heat-insulating door 3, there is provided a door gasket 41 that, when the heat-insulating door 3 is closed, makes intimate contact with an outer plate 42 arranged at the open side of the refrigerator 1. The portion around the door gasket 41 is so structured that, as the heat-insulating door 3 is opened or closed or in other situations, cold air 40 makes direct contact with the door gasket 41 or the outer plate 42. Thus, this portion of the insulating door 3 tends to become especially cold as compared with the other portion thereof, and is therefore prone to collect dew resulting from condensation of moisture contained in outside air. When dew collects, it may drip to make the floor wet, or may produce rust.

In common refrigerators, collection of dew is prevented by disposing a heater behind the portion of the outer plate 42 that makes contact with the door gasket 41 so that this portion is heated to a temperature close to the temperature outside. However, using such a dew prevention heater results in extra electric power consumption, and is therefore disadvantageous to energy saving.

To overcome this, as shown in FIGS. 1 to 3, the dew prevention heat pipes are, at one end (the heat-absorbing evaporator portion), inserted into small holes formed in an end surface of the warm head 9 so as to be coupled thereto, and are, at the other end (the heat-rejecting condenser portion) laid freely in the heat-insulating material 2 at the open side of the refrigerator 1. In this embodiment, as shown in FIG. 6, the dew prevention heat pipes are laid so as to run along the portion of the outer plate 42 that makes contact with the door gasket 41.

In this construction, part of the waste heat rejected from the warm head 9 of the Stirling refrigerating device is transferred by way of the dew prevention heat pipes 17 to around the door gasket 41 to heat the portion around the door gasket 41, and this prevents collection of dew there. Thus, according to the present invention, there is no need to use an electric heater to prevent collection of dew, and it is therefore possible to save energy.

Moreover, by way of the dew prevention heat pipes 17, cold that has leaked out of the refrigerator interior is absorbed, and, through the portion of the outer plate 42 that makes contact with the dew prevention heat pipes 17, heat exchange takes place between the warm head 9 and the outside space. This alleviates the load on the heat-rejecting heat exchanger 10, and thus helps miniaturize it. Instead of the dew prevention heat pipes 17 described above, a thermosiphon may be used.

Drain water resulting from defrosting or the like of the refrigerator interior and the heat-absorbing heat exchanger 12 is collected in the drain collection pan 15 disposed at the bottom of the refrigerator 1. Thus, to prevent the drain water collected in the drain collection pan 15 from overflowing, it is necessary to periodically dispose of drain water. In conventional refrigerators exploiting the vapor compression refrigerating cycle, drain water is evaporated by using the heat rejected when a refrigerant is condensed and liquefied in a condenser. This eliminates the need to periodically take out the drain collection pan 15 to dispose of the drain water collected therein, and thus saves trouble in terms of maintenance. However, in the Stirling refrigerating device 8 exploiting the reversed Stifling cycle, there is provided no component that corresponds to a condenser, and therefore it is not possible to dispose of drain water by using the heat rejected from a condenser.

To overcome this, as shown in FIGS. 2 and 3, the drain evaporation heat pipes 16 are, at one end (the heat-absorbing evaporator portion), inserted into small holes formed in an end surface of the warm head 9 of the Stirling refrigerating device 8 so as to be coupled thereto, and are, at the other end (the heat-rejecting condenser portion), located inside the drain collection pan 15 disposed at the bottom inside the machine compartment 4 of the refrigerator body 1.

In this construction, part of the waste heat rejected from the warm head 9 is fed by way of the drain evaporation heat pipes 16 to drain water so as to prompt it to evaporate. Moreover, the drain evaporation heat pipes 16 are kept in intimate contact with the bottom surface of the drain collection pan 15, which is made of a material with high thermal conductivity, so that part of the heat transferred by way of the drain evaporation heat pipes 16 from the warm head 9 is fed through the drain collection pan 15 to drain water. This increases the effective thermal conduction area over which heat is fed to drain water, and thus makes efficient evaporation of drain water possible.

Thus, drain water evaporates quickly before collecting in the drain collection pan 15. This prevents drain water from overflowing, and makes the drain collection pan 15 free from maintenance. Moreover, part of the waste heat rejected from the warm head 9 of the Stirling refrigerating device 8 is fed by way of the drain evaporation heat pipes 16 to prompt drain water to evaporate. This alleviates the load of heat exchange on the heat-rejecting heat exchanger 10. According to the degree to which the amount of rejected heat is reduced, it is possible to reduce the amount of cooling air blown onto the heat-rejecting heat exchanger 10, and thereby reduce the output and thus the rotation rate of the air-cooling fan 14. This helps reduce the electric power consumption of the air-cooling fan 14 and thereby save energy.

Figure 7:
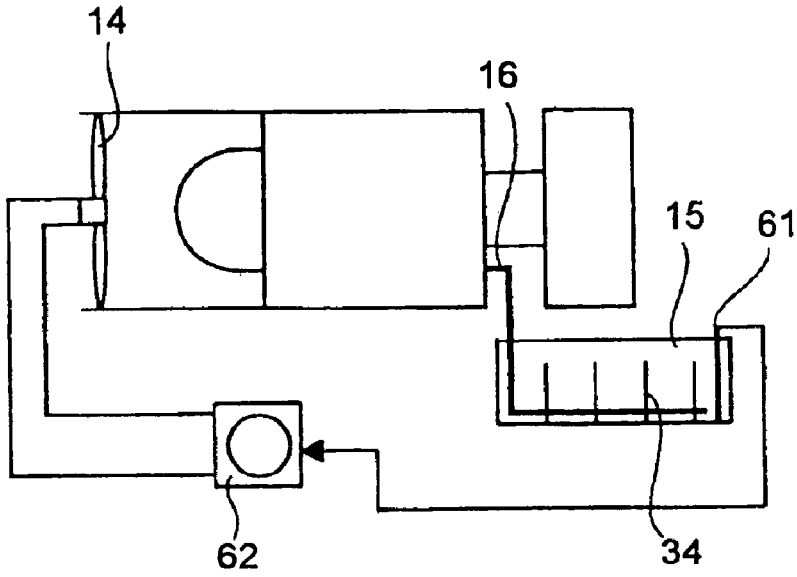
FIG. 7 is a diagram schematically illustrating an example of the air-cooling fan control mechanism of the refrigerating unit.

However, it is when the refrigerator 1 is operated in a dehumidifying mode or the like that drain water collects intermittently in the drain collection pan 15. That is, the drain evaporation heat pipes 16 perform their function only when a certain amount of drain water has collected in the drain collection pan 15 as after dehumidifying of the refrigerator interior. Therefore, in the present invention, as shown in FIG. 7, a water level detection sensor 61 is provided inside the drain collection pan 15 so that, according to the signal from the water level detection sensor 61, the rotation rate of the air-cooling fan 14 is controlled by a power control circuit 62.

Specifically, when the water level detection sensor 61 recognizes that there is drain water in the drain collection pan 15, the drain water can be evaporated effectively by transferring waste heat by way of the drain evaporation heat pipes 16. Therefore, the power control circuit 62 turns off the electric power fed to the air-cooling fan 14. On the other hand, when there is no drain water in the drain collection pan 15, and thus there is no drain water to evaporate, the air-cooling fan 14 is rotated at the rated rotation rate to prompt heat rejection from the heat-rejecting heat exchanger 10.

Figure 8:
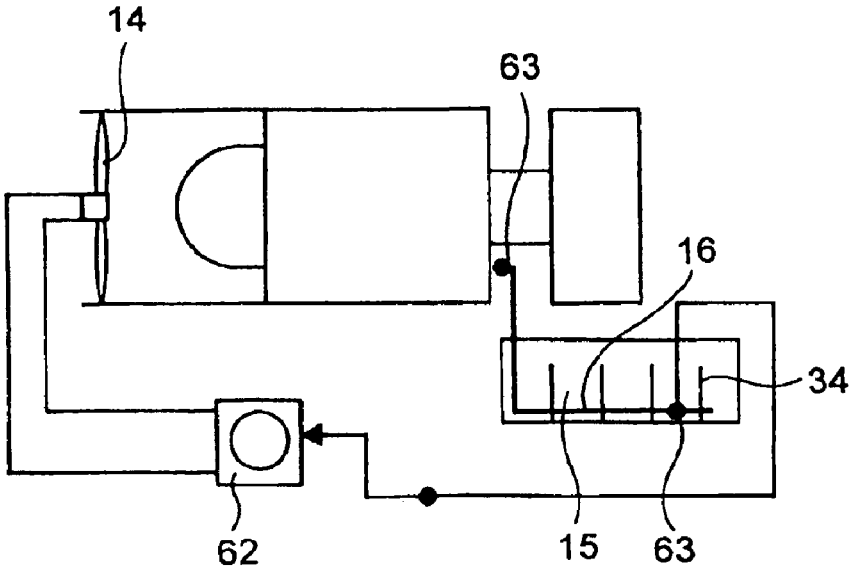
FIG. 8 is a diagram schematically illustrating another example of the air-cooling fan control mechanism of the refrigerating unit.

Instead of the water level detection sensor 61 described above, as shown in FIG. 8, temperature sensors 63 and 63, such as thermocouples, may be provided at both ends of the drain evaporation heat pipes 16, i.e. the heat-absorbing evaporator portion and the heat-rejecting condenser portion thereof. The results of detection by these temperature sensors are fed to the power control circuit 62 so that, according to those results, the power control circuit 62 checks whether the drain evaporation heat pipes 16 are operating or not and controls the rotation rate of the air-cooling fan 14.

In a case where the drain evaporation heat pipes 16 are kept in intimate contact with the drain collection pan 15, which is made of a material with high thermal conductivity, the heat transferred by way of the drain evaporation heat pipes 16 is fed through the drain collection pan 15 to drain water. This increases the area over which heat is fed to drain water, and thus permits efficient and quick evaporation of drain water.

Furthermore, a plurality of flat-plate fins 34 having a water absorbing effect and extending in opposite directions may be fitted to the heat-rejecting condenser portion of the drain evaporation heat pipes 16 located inside the drain collection pan 15. In this construction, the flat-plate fins 34 increase the effective thermal conduction area with respect to drain water, and prompts evaporation of drain water. In this case, even when the level of drain water is so low to scarcely reach a low portion of the flat-plate fins 34, the drain water is sucked up along the surfaces of the flat-plate fins 34. Thus, the entire surfaces of the flat-plate fins 34 become wet, offering a wide evaporation area all the time. Moreover, as compared with a case where heat conduction is achieved only through the drain collection pan 15, it is possible to maintain a wider thermal conduction area. This permits the drain collection pan 15 to be made of a material other than one with high thermal conductivity.

Figure 9A:
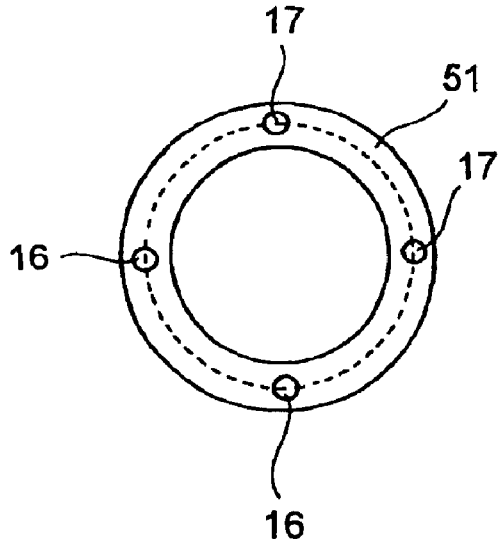
FIG. 9A is a front view of the thermal conduction base placed between the warm head and the heat-rejecting heat exchanger of the refrigerating unit.
Figure 9B:
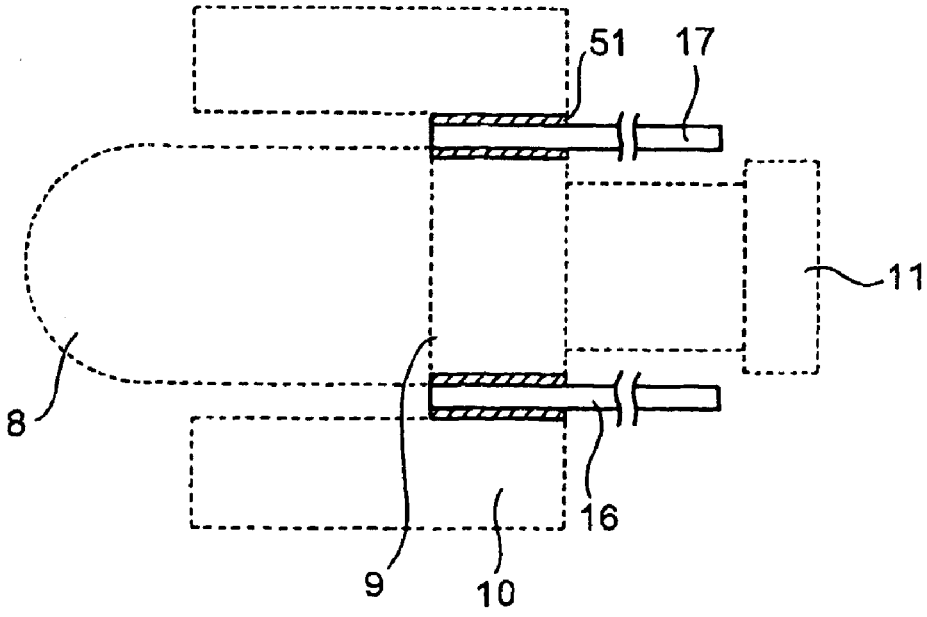
FIG. 9B is a side view of the thermal conduction base placed between the warm head and the heat-rejecting heat exchanger of the refrigerating unit.

The dew prevention heat pipes 17 and the drain evaporation heat pipes 16 described above are, at one end, coupled to the warm head 9 by being fixed to an end surface of the warm head 9 with adhesive or by being inserted into small holes formed in the end surface of the warm head 9. In a case where it is impossible to secure sufficient space to lay the drain evaporation heat pipes 16 and the dew prevention heat pipes 17 on the side surface of the warm head 9, or in a case where the coupling portions of the drain evaporation heat pipes 16 and the dew prevention heat pipes 17 are to be formed into a unit, as shown in a front view and a sectional view in FIGS. 9A and 9B respectively, a ring-shaped thermal conduction base 51 having an internal diameter substantially equal to the external diameter of the warm head 9 may be fitted around the warm head 9 with the drain evaporation heat pipes 16 and the dew prevention heat pipes 17, at one end, inserted into a plurality of small holes formed around the circumference of an end surface of the thermal conduction base 51.

This allows easy coupling of the dew prevention heat pipes 17 or the drain evaporation heat pipes 16 with the warm head 9, and allows efficient rejection of the waste heat transferred from the warm head 9 to the heat-rejecting heat exchanger 10.

Incidentally, in a case where the warm head 9 is located higher than the drain collection pan 15, the drain evaporation heat pipes 16 suffer from top heating. Thus, depending on their length, their function is greatly diminished or even totally lost.

Figure 17:
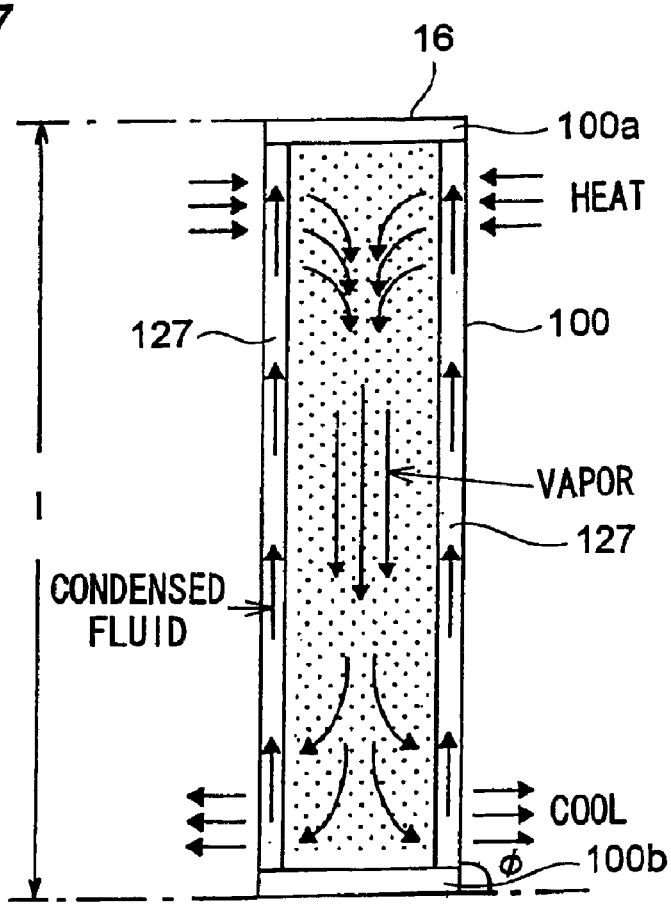
FIG. 17 is a sectional view illustrating the principle of operation of the heat pipes.

Now, the principle of operation of the drain evaporation heat pipes 16 will be described with reference to FIG. 17, which is a sectional view showing a model thereof. The drain evaporation heat pipes 16 consist of a refrigerant sealed in a hermetic cylindrical vessel 100. When one end 100*a* (hereinafter referred to as the "evaporator portion") of the vessel 100 is heated, the refrigerant inside evaporates, and the vapor of the refrigerant moves to the other, cooled end 100*b* (hereinafter referred to as the "condenser portion"). The refrigerant that has reached the condenser portion 100*b* condenses and liquefies, and then returns to the evaporator portion 100*a* by the capillary effect of a wick 127 laid on the inner wall of the vessel 100.

For the drain evaporation heat pipes 16 to operate normally, the maximum head (height difference) ($\Delta P_{cmax}$) over which the capillary effect of the wick 127 can suck up water needs to be greater than the total pressure drop inside the drain evaporation heat pipes 16, as represented by formula (1) below.

$$\Delta P_{cmax} > \Delta P_1 + \Delta P_v + \Delta P_g \quad (1)$$

Here, $\Delta P_1$ represents the pressure drop in the liquid-state refrigerant, $\Delta P_v$ represents the pressure drop in the vapor-state refrigerant, and $\Delta P_g$ represents the potential head (the pressure drop due to gravity). $\Delta P_g$ is determined by formula (2) below from the density $\rho_1$ of the liquid-state refrigerant, the gravitational acceleration g, the total length 1 of the drain evaporation heat pipes 16, and the angle $\phi$ at which the drain evaporation heat pipes 16 are disposed (i.e. the angle of the line connecting the evaporator portion 100*a* to the condenser portion 100*b* relative to the horizontal direction, within the range of from −90° to +90°).

$$\Delta P_g = \rho_1 \times g \times 1 \times \sin\phi \quad (2)$$

Hence, as shown in the figure, when the evaporator portion 100*a* is located above the condenser portion 100*b*, resulting in top heating ($\phi > 0$), the potential head $\Delta P_g$ increases in proportion to the total length l of the drain evaporation heat pipes 16. Thus, when the relationship represented by formula (1) above no longer holds, the wick 127 becomes dry in the evaporator portion 100*a*, and the function of the drain evaporation heat pipes 16 may be greatly diminished or even totally lost. This imposes a limit on the location (height) at which to dispose the Stirling refrigerating device.

<Second Embodiment>

Figure 10:
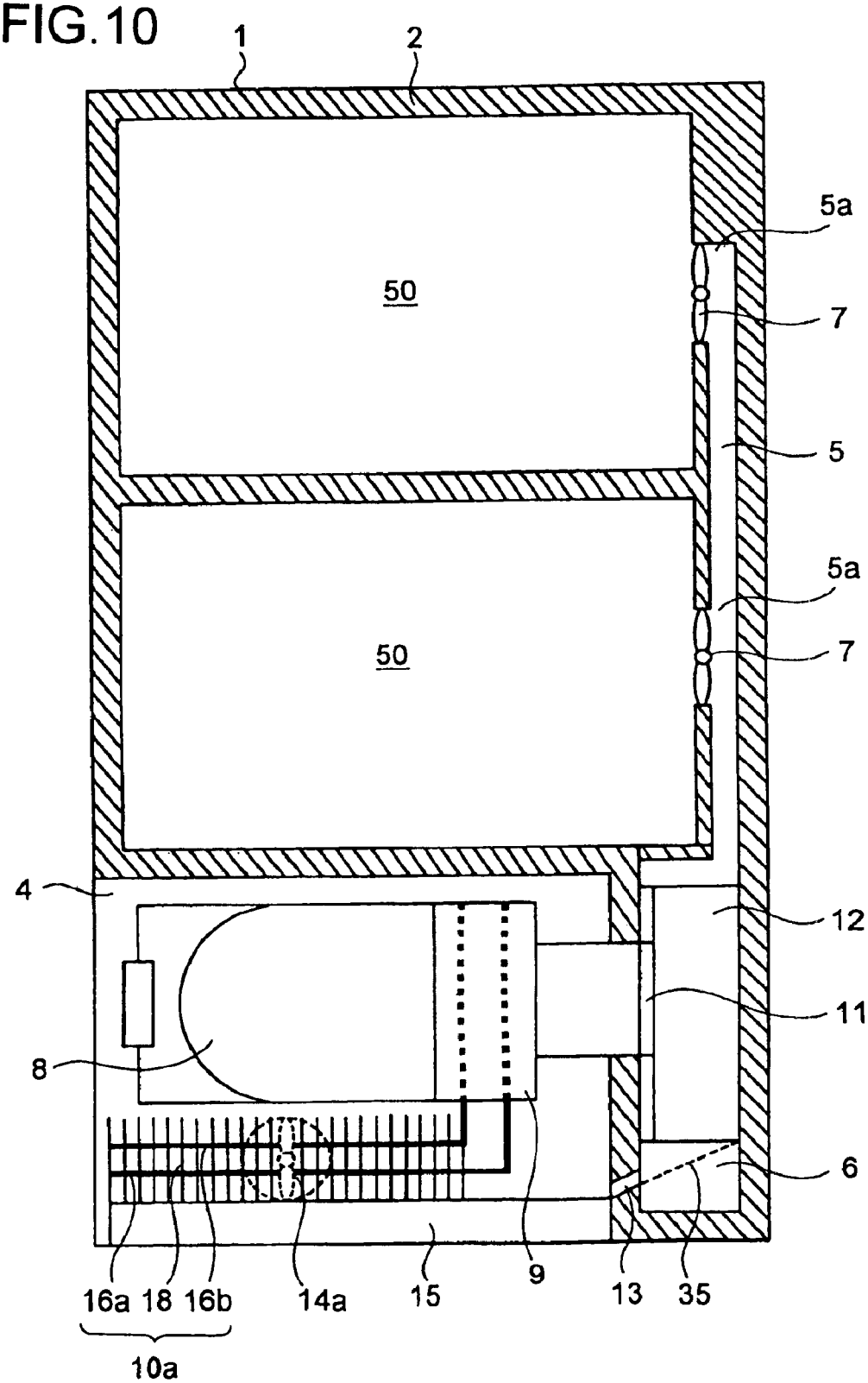
FIG. 10 is a schematic rear sectional view of the refrigerator of a second embodiment of the invention.
Figure 11:
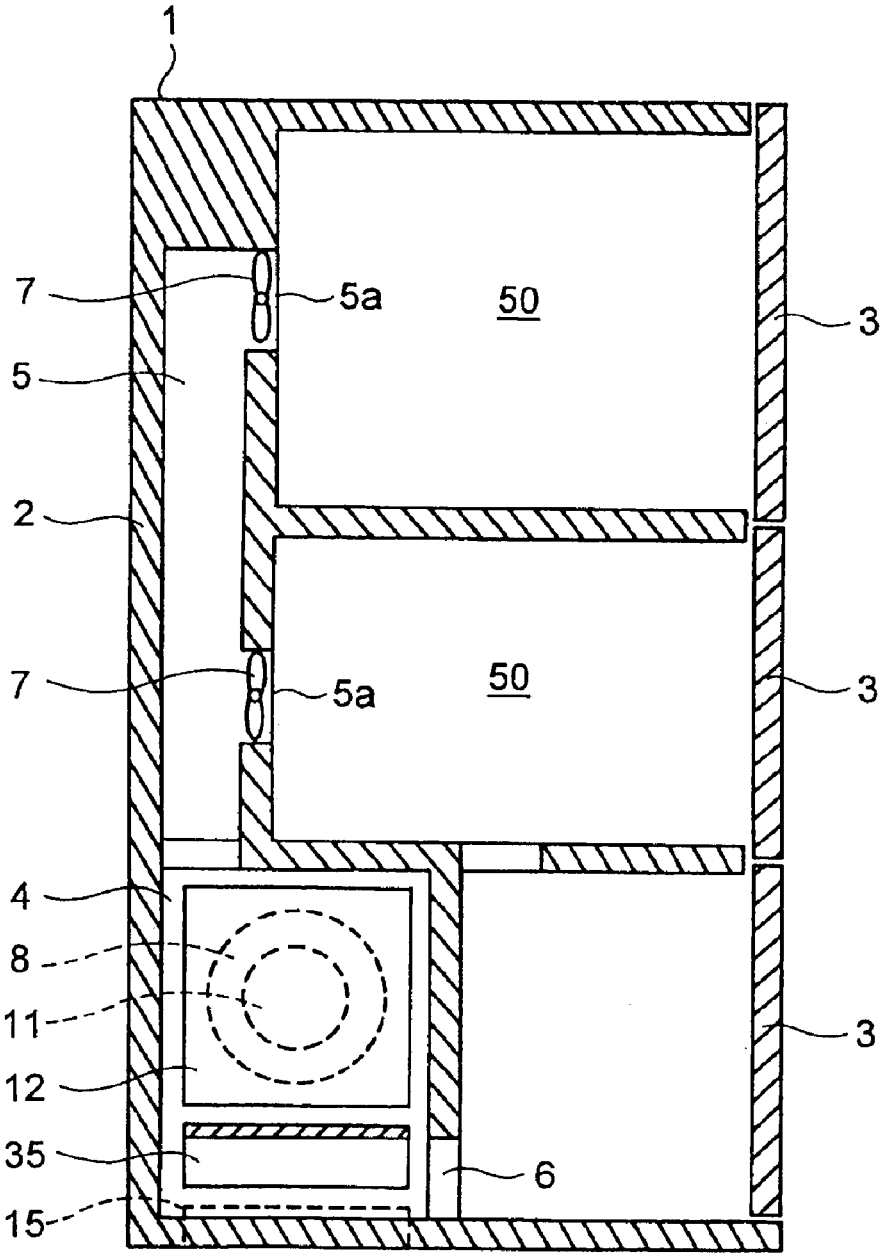
FIG. 11 is a schematic side sectional view of the refrigerator.
Figure 12:
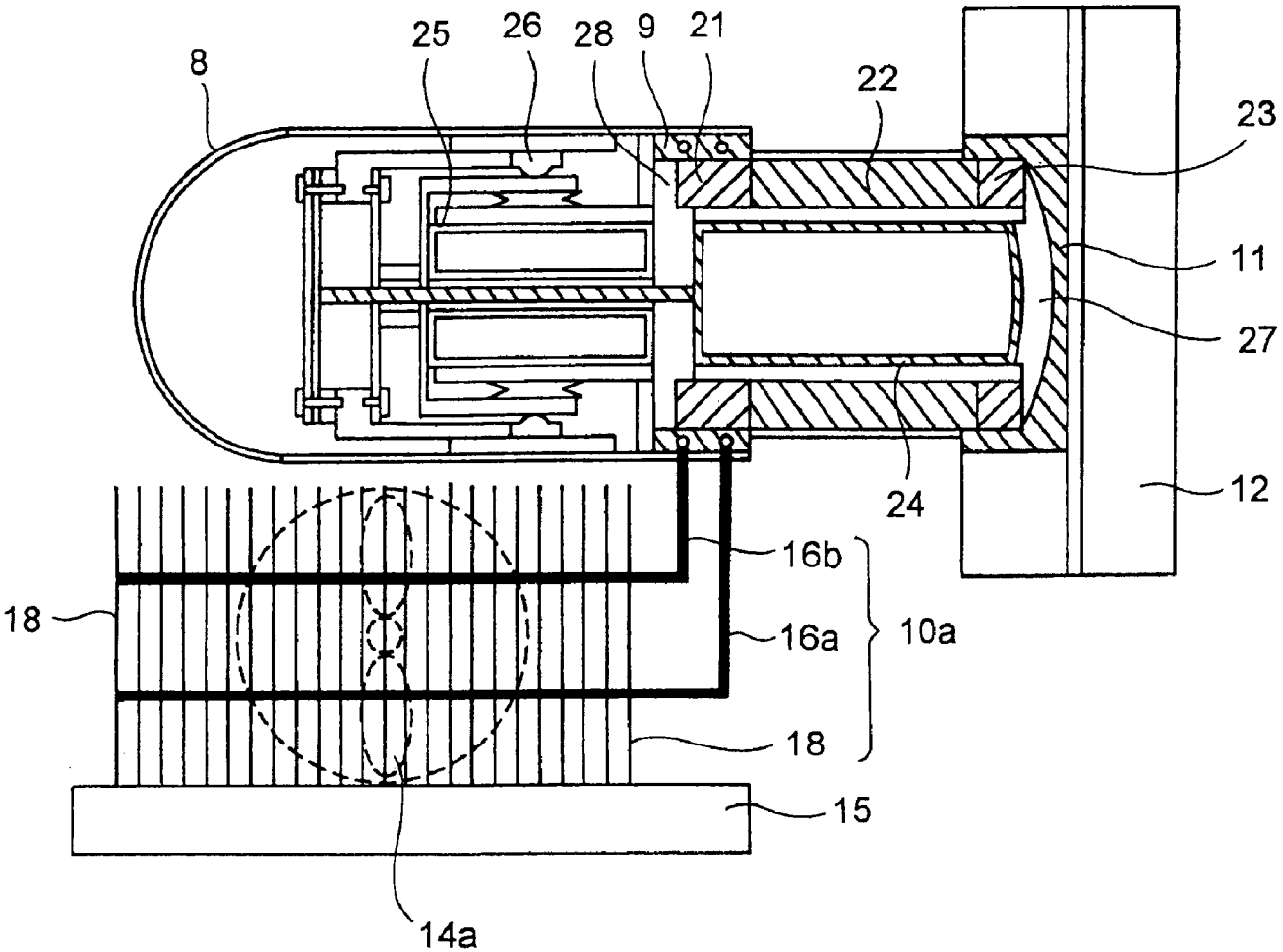
FIG. 12 is a sectional view of the refrigerating system incorporated in the refrigerator.

FIG. 10 is a schematic rear sectional view of the refrigerator of a second embodiment of the invention, and FIG. 11 is a schematic side sectional view of the refrigerator. FIG. 12 is a sectional view of its refrigerating unit. In these figures, reference numeral 1 represents a body of the refrigerator, reference numeral 2 represents a heat-insulating material filling the gap between an inner case and an outer case of the body 1, reference numeral 3 represents heat-insulating doors for opening and closing openings in the front faces of storage compartments 50, and reference numeral 4 represents a machine compartment in which a refrigerating unit, described later, is housed.

A cold air duct 5 communicates with the storage compartments 50 through openings 5*a* formed in the rear faces thereof. Inside the cool air duct 5, near the openings 5*a*, cold air fans 7 for blowing cold air into the storage compartments 50 are provided. The cold air that has been circulated inside the storage compartments 50 by the cold air fans 7 returns into a return duct 6, and passes through a heat-absorbing heat exchanger 12 fitted to a cold head 11 of a Stirling refrigerating device 8. The cold air that thus has its heat absorbed and is thereby cooled circulates again through the cool air duct 5 and enters the storage compartments 50 through the openings 5*a* to cool the interior of the storage compartments 50.

The refrigerating unit is housed in the machine compartment 4 formed in a lowest, deepest portion of the refrigerator body 1 by being separated by the heat-insulating material 2. As shown in FIG. 12, the refrigerating unit includes a Stirling refrigerating device 8, a heat-rejecting heat exchanger 10*a* (composed of heat pipes 16*a* and 16*b* and flat-plate fins 18) thermally coupled to a warm head 9, a heat-absorbing heat exchanger 12 fitted to a cold head 11, and an air-cooling fan 14*a*. The heat pipes 16*a* and 16*b* are, at one end, embedded so as to be thermally kept in contact with the warm head 9. The number of heat pipes is not limited to two.

The Stirling refrigerating device 8 is composed of a displacer 24 for quickly expanding a working medium, such as helium sealed inside a cylinder, in an expansion space 27, a piston 25 for quickly compressing the working medium in a compression space 28, a linear motor 26 for driving the piston 25 to reciprocate, a heat-absorption-side internal heat exchanger 23 disposed in the expansion space 27, a heat-rejection-side internal heat exchanger 21 disposed in the compression space 28, and a heat-storing heat exchanger 22 placed between the heat-absorption-side internal heat exchanger 23 and the heat-rejection-side internal heat exchanger 21 so as to form a closed circuit through which the expansion space 27 and the compression space 28 communicate with each other.

In the Stirling refrigerating device 8 constructed as described above, when the linear, motor 26 is operated, the displacer 24 and the piston 25, which are disposed coaxially, reciprocate with a fixed phase difference (generally, about 90°) kept between them. As a result, the working medium compressed in the compression space 28 by the piston 25 is heated, and its heat is rejected through the heat-rejection-side internal heat exchanger 21, the warm head 9, and the heat pipes 16*a* and 16*b* from the flat-plate fins 18. The heat is also transferred to the heat-storing heat exchanger 22. The working medium then flows into the expansion space 27.

The working medium expanded in the expansion space 27 by the displacer 24 is cooled, and absorbs heat through the heat-absorption-side internal heat exchanger 23 and the cold head 11 from the heat-absorbing heat exchanger 12. The working medium then, while passing through the heat-storing heat exchanger 22, absorbs heat, and thus returns, preheated, to the compression space 28. The cycle of operations described above is repeated to absorb heat through the heat-absorbing heat exchanger 12 placed inside the cold air duct 5 (see FIG. 10) and thereby produce cold air.

Incidentally, the heat-absorbing heat exchanger 12 is used below the freezing point of water, and therefore frost collects thereon as a result of condensation of moisture contained in the cold air circulated through the cold air duct 5. Where frost collects, heat exchange efficiency lowers, and performance degrades. Therefore, it is necessary to perform defrosting according to how frost collects. Drain water resulting from defrosting flows along the surface of a plate-shaped drain collecting member 35 disposed with an inclination below the heat-absorbing heat exchanger 12, then passes through a drain discharge path 13, and is then collected in a drain collection pan 15. Thus, to prevent the drain water collected in the drain collection pan 15 from overflowing, it is necessary to dispose of drain water when necessary.

To avoid this, as shown in FIG. 10, above the drain collection pan 15, a plurality of flat-plate fins 18 extending in opposite directions are disposed in such a way that the heat pipes 16*a* and 16*b* penetrate them substantially horizontally. This thermally couples the warm head 9 with the flat-plate fins 18 by way of the heat pipes 16*a* and 16*b*. As a result, the refrigerant in the heat pipes 16*a* and 16*b* is heated by the warm head 9, which is hot, and thus evaporates. The vapor of the refrigerant moves to the other end where the flat-plate fins 18 are fitted, and condenses there, where heat of condensation is released.

This heat is rejected substantially evenly from the surfaces of the flat-plate fins 18, which have a wide heat rejection area. In addition, through the gaps between the flat-plate fins 18, wind blows as the air-cooling fan 14*a* rotates. This prompts heat rejection from the surfaces of the flat-plate fins 18. Moreover, the heated wind is blown onto the surface of the drain water in the drain collection pan 15 to heat it. This permits the drain water to evaporate quickly, and thus makes it possible to dispose of drain water on a maintenance-free basis.

Moreover, in the construction of this embodiment, the length of the heat pipes 16*a* and 16*b* in the vertical direction can be reduced by reducing the distance between the warm head 9 and the flat-plate fins 18. This helps reduce the potential head. Accordingly, the refrigerant that has condensed in the heat pipes 16*a* and 16*b* can be moved toward the warm head 9 without fail by the capillary effect. This helps prevent malfunctioning of the heat pipes 16*a* and 16*b*.

Figure 13:
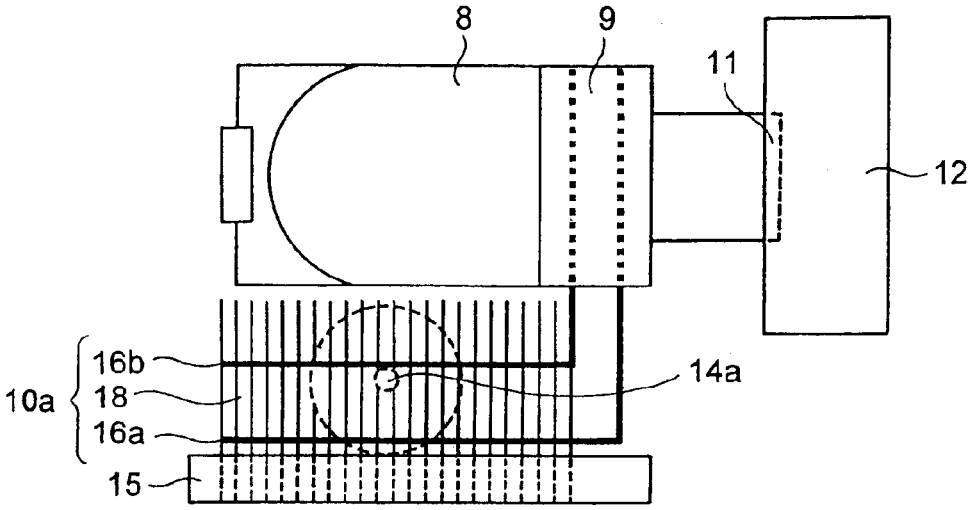
FIG. 13 is a plan view of another example of the heat-rejecting heat exchanger of the refrigerating system.

This embodiment may be modified as shown in FIG. 13, where the length of the flat-plate fins 18 is so determined as to partially make contact with the drain water in the drain collection pan 15. This allows part of the waste heat from the warm head 9 to be fed through the flat-plate fins 18 to the drain water. This, in combination with the blowing of hot air by the air-cooling fan 14*a*, permits quicker disposal of drain water. Here, part of waste heat is rejected through heat exchange with drain water. This helps reduce the load on the air-cooling fan 14*a* that blows wind to the flat-plate fins 18 and thereby save energy.

Figure 14:
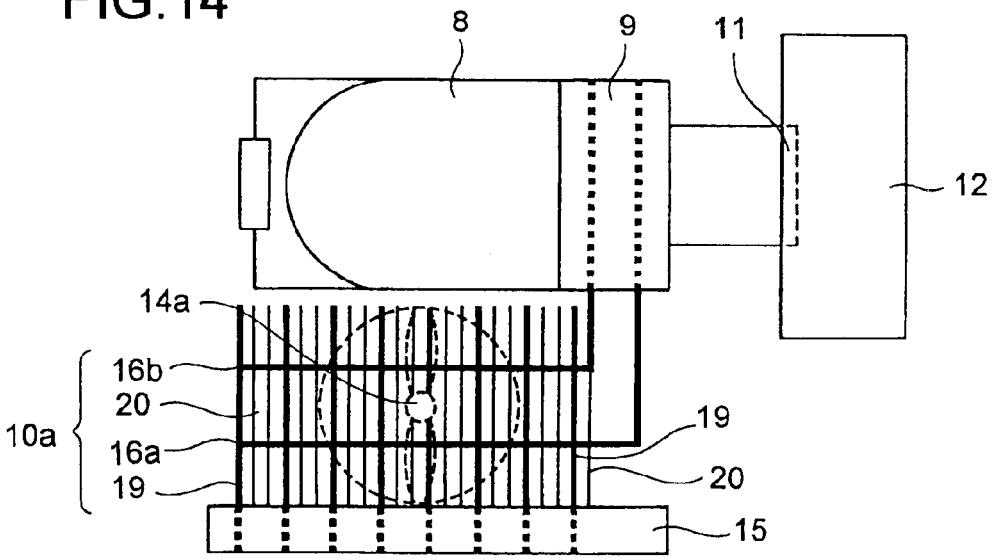
FIG. 14 is a plan view of still another example of the heat-rejecting heat exchanger of the refrigerating system.

Alternatively, as shown in FIG. 14, every third flat-plate fin 19 may be made longer than the other flat-plate fins 20 so as to make contact with the drain water in the drain collection pan 15. This helps reduce resistance to air resulting from narrow air passages between the fins, and thus helps reduce the noise produced by the air-cooling fan 14*a*. In this case, to minimize thermal resistance, it is advisable to make the longer flat-plate fins 19 thicker than the shorter flat-plate fins 20. The flat-plate fins 19 may be disposed at random intervals.

Figure 18:
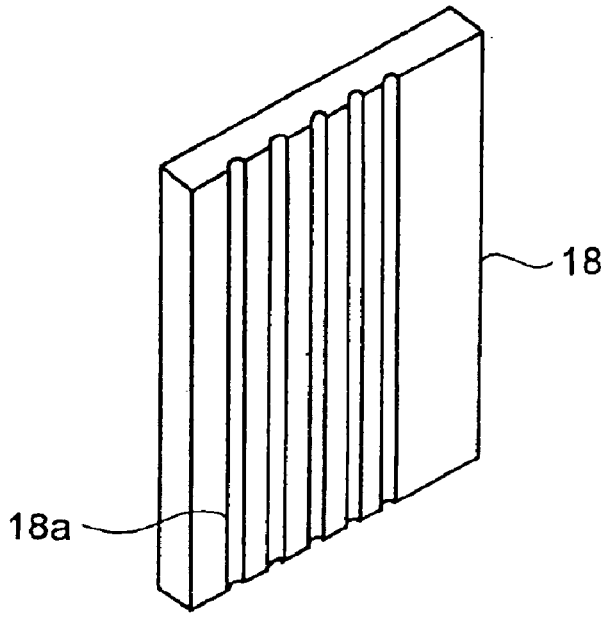
FIG. 18 is a perspective view of a flat-plate fin with grooves having a capillary effect formed on its surface.
Figure 19:
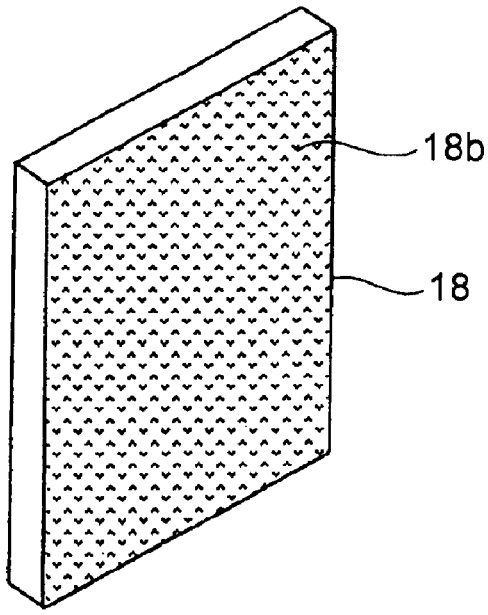
FIG. 19 is a perspective view of a flat-plate fin of which the surface is treated by blackening.

It is also possible to form semicircular or V-shaped grooves 18*a* having a capillary effect in those portions of the surfaces of the flat-plate fins 18 which make contact with drain water as shown in FIG. 18, or to form surface irregularities 18*b* on those surfaces by treating them by blackening as shown in FIG. 19. In either way, the flat-plate fins 18 have a water absorbing effect, and thus allow drain water to rise along the surfaces of the flat-plate fins 18 and evaporate therefrom. This increases the evaporation area, and thus permits even quicker disposal of drain water.

<Third Embodiment>

Figure 15:
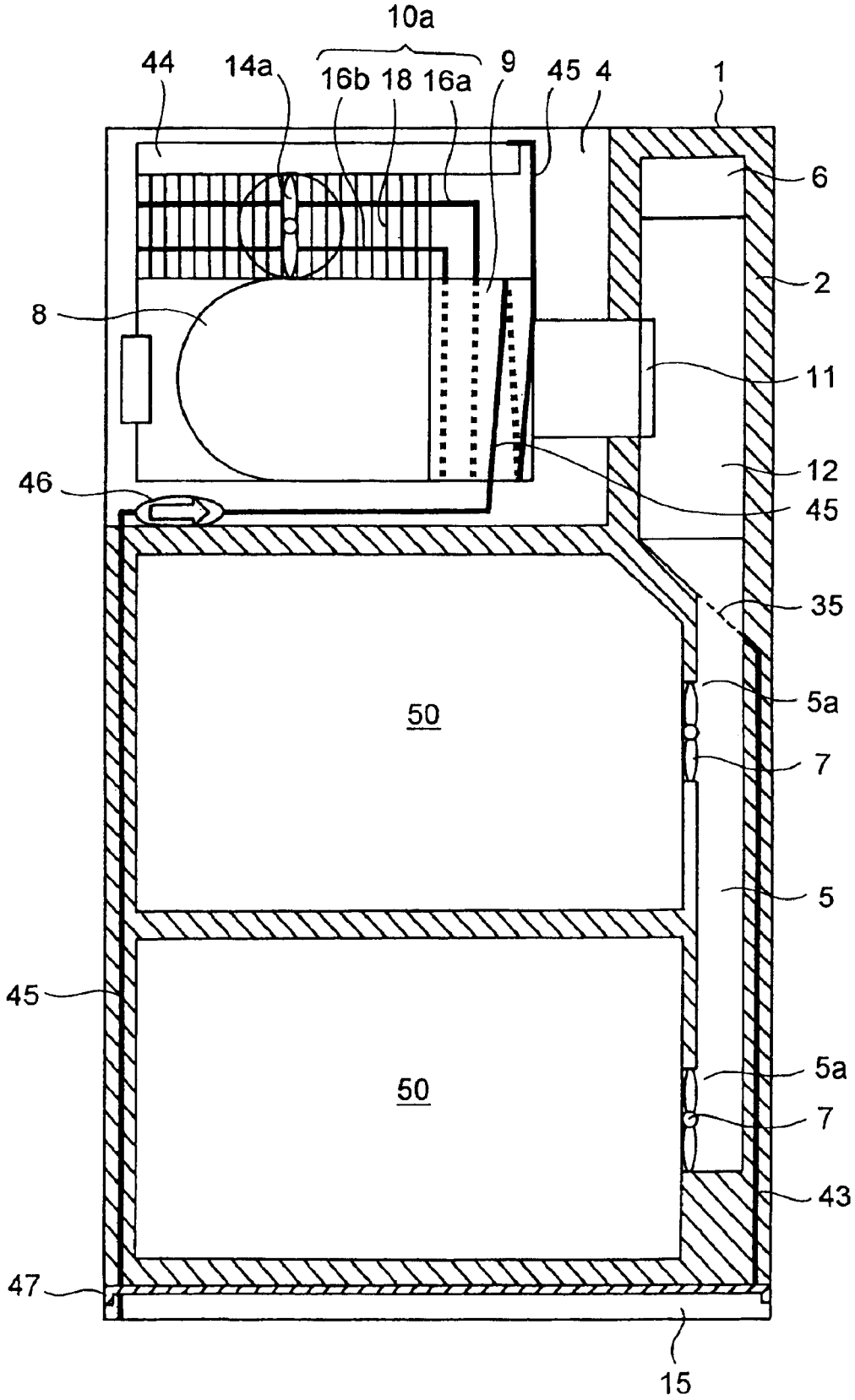
FIG. 15 is a schematic rear sectional view of the refrigerator of a third embodiment of the invention.

FIG. 15 is a schematic rear sectional view of the refrigerator of a third embodiment of the invention. In this figure, such components as are common to the refrigerator of the second embodiment described above are identified with the same reference numerals, and their detailed explanations will not be repeated.

The refrigerating unit is housed in a machine compartment 4 formed in a highest, deepest portion of the refrigerator body 1 by being separated by the heat-insulating material 2. As shown in FIG. 15, the refrigerating unit includes a Stirling refrigerating device 8, a heat-rejecting heat exchanger 10*a* (composed of two heat pipes 16*a* and 16*b* and flat-plate fins 18) connected to a warm head 9, a heat-absorbing heat exchanger 12 fitted to a cold head 11, and an air-cooling fan 14*a*. The heat pipes 16*a* and 16*b* are, at one end, embedded so as to be thermally kept in contact with the warm head 9.

At the bottom of the body 1, there is disposed a drain collection pan 15 that is hermetically closed by a lid 47. Moreover, below the heat-absorbing heat exchanger 12, there is arranged a drain collecting member 35, which is an inclined plate-shaped member. The drain collecting member 35 is connected to the top end of a drain discharge pipe 43 arranged vertically inside the heat-insulating material 2. The bottom end of the drain discharge pipe 43 communicates with the interior of the drain collection pan 15 so that drain water is collected in the drain collection pan 15. However, since the warm head 9 is located far higher than the drain collection pan 15, it is difficult to operate heat pipes over this distance.

Now, the characteristic features of this embodiment will be described. A plurality of flat-plate fins 18 extending in opposite directions are, by way of the heat pipes 16*a* and 16*b* that penetrate them substantially horizontally, thermally coupled to the warm head 9. Above these flat-plate fins 18, there is disposed a drain evaporation pan 44 made of a material with thermal conductivity. The drain evaporation pan 44 is connected to the drain collection pan 15 so as to communicate therewith by way of a pipe 45 arranged inside the heat-insulating material 2 so as to reach the interior of the machine compartment 4. Midway along the pipe 45, there is provided a pump 46 for pumping up the drain water collected in the drain collection pan 15. As shown in the figure, part of the pipe 45 is, between the pump 46 and the drain evaporation pan 44, wound around the warm head 9.

In the construction described above, when the Stirling refrigerating device 8 is operated, on the principle described earlier, heat is absorbed from the cold head 11, so that the heat-absorbing heat exchanger 12 fitted to the cold head 11 is cooled to a low temperature. As a result, air around the heat-absorbing heat exchanger 12 inside the cold air duct 5 is cooled, and this cold air is blown into the storage compartments 50 as the cold air fans 7 rotate. The cold air circulates inside the storage compartments 50 to cool the interior thereof, and then returns through the return duct 6 into the cold air duct 5. The cold air is then, while passing through the heat-absorbing heat exchanger 12, cooled so as to contribute again to the cooling of the interior of the storage compartments 50.

Incidentally, the heat-absorbing heat exchanger 12 is used below the freezing point of water, and therefore frost collects thereon as a result of condensation of moisture contained in the cold air circulated through the cold air duct 5. Where frost collects, heat exchange efficiency lowers, and performance degrades. Therefore, it is necessary to perform defrosting according to how frost collects. Drain water resulting from defrosting flows along the surface of the plate-shaped drain collecting member 35 into the drain discharge pipe 43, then drips through this drain discharge pipe 43, and is then collected in the drain collection pan 15. Thus, to prevent the drain water collected in the drain collection pan 15 from overflowing, it is necessary to dispose of drain water when necessary.

When the drain water in the drain collection pan 15 needs to be disposed of, the pump 46 is operated so that the drain water is pumped up by way of the pipe 45 so as to be transferred to the drain evaporation pan 44. Meanwhile, the drain water is heated as it passes through the portion of the pipe 45 that is wound around the warm head 9. Thus, the drain water is warmer when transferred to the drain evaporation pan 44. As the air-cooling fan 14*a* rotates, wind blows through the gaps between the flat-plate fins 18, and the heated wind heats the drain evaporation pan 44. This allows the drain water in the drain evaporation pan 44 to evaporate quickly, and thus makes it possible to dispose of drain water on a maintenance-free basis. Moreover, the provision of the structure for pumping up drain water makes it possible to locate the Stirling refrigerating device at the desired height and thereby realize a refrigerator with enhanced usability.

In addition, the drain water passing through the pipe 45 prompts heat rejection from the warm head 9. This reduces the load on the air-cooling fan 14*a*, and thus helps save energy. Moreover, in this embodiment, the drain collection pan 15 is hermetically closed by the lid 47. This prevents entry of dust into the drain collection pan 15. In this way, it is possible to prevent entry of dust into the pump 46 and thereby prevent failure or malfunctioning thereof. Instead of the lid 47, any structure that hermetically closes the drain collection pan 15 may be used for the same purpose.

Figure 16:
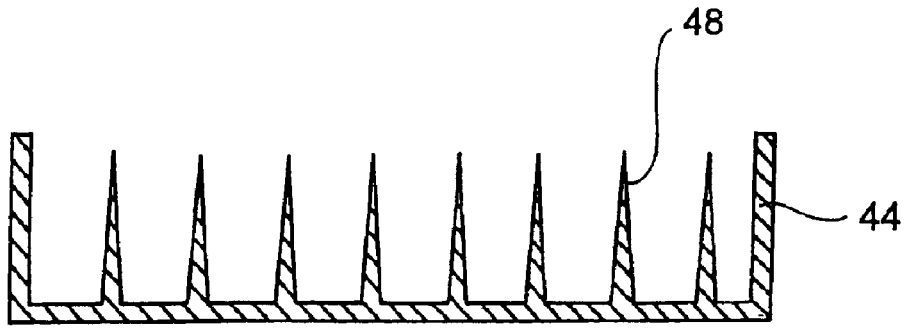
FIG. 16 is a sectional view of an example of the drain evaporation pan provided in the refrigerator.

Furthermore, as shown in FIG. 16, the drain evaporation pan 44 may be provided with grooved ribs 48 made of a highly water-diffusing material. This allows drain water to be distributed evenly over the entire surfaces of the ribs 48, and thus permits still quicker evaporation of drain water.

The embodiments described above deal with free-piston-type Stirling refrigerating devices. However, the present invention applies also to Stirling refrigerating devices of other types than the free-piston type. The embodiments described above deal with refrigerators. However, needless to say, the present invention applies also to other types of refrigerator provided with a Stirling refrigerating device (for example, refrigerated show cases) to achieve the same advantages.

INDUSTRIAL APPLICABILITY

As described above, according to the present invention, waste heat rejected from the heat rejecter of a Stirling refrigerating device is transferred by way of dew prevention heat pipes to heat the open side of a refrigerator. This makes it possible to prevent, in an effective and energy-saving manner, condensation of moisture at the open side of the refrigerator, where dew tends to collect as a door is opened and closed or in other situation, without using a heater.

Moreover, according to the present invention, waste heat rejected from the heat rejecter is transferred through drain evaporation heat pipes to evaporate drain water collected in a drain collection pan as a result of defrosting or the like of the interior of the refrigerator. This makes it possible to evaporate drain water on an energy-saving manner without using a heater, and thereby make the drain collection pan free from maintenance. In this case, the drain evaporation heat pipes may be, at the other end, fitted with a plurality of fins that partially make contact with the drain water. This allows the drain water to absorb heat and thereby prompt heat rejection. This alleviates the load on the air-cooling fan or the like and thereby save energy.

Moreover, according to the present invention, with a waver level detection sensor provided inside the drain collection pan, the level of the water in the drain collection pan is detected, and, according to the result of detection, the rotation rate of the air-cooling fan that blows wind onto the heat rejecter and the heat-rejecting heat exchanger of the Stirling refrigerating device is controlled. This effectively reduces the electric power consumption of the air-cooling fan, and thus helps realize an energy-saving refrigerator.

Moreover, according to the present invention, with temperature sensors provided at both ends of the drain evaporation heat pipes, whether heat is being transferred or not is detected, and, according to the result of detection, the rotation rate of the air-cooling fan that blows wind onto the heat rejecter and the heat-rejecting heat exchanger of the Stirling refrigerating device is controlled. This effectively reduces the electric power consumption of the air-cooling fan, and thus helps realize an energy-saving refrigerator.

Moreover, for example in a case where the Stirling refrigerating device is located in an upper portion of the Stirling refrigerator, when the heat rejecter is located far above the drain collection pan, the drain water in the drain collection pan is pumped up so as to be transferred to a drain evaporation pan so that the drain water is evaporated quickly by using waste heat from the heat rejecter. This permits drain water to be disposed of on a maintenance-free basis. In this case, if part of the pipe through which drain water is transferred is kept in contact with the heat rejecter of the Stirling refrigerating device, the drain water passing through the pipe absorbs heat from the heat rejecter and thereby prompts heat rejection. This alleviates the load on the air-cooling fan or the like, and thus helps save energy.

By providing the drain collection pan with a lid so that it is hermetically closed, it is possible to prevent dust from entering the drain collection pan. In this way, it is possible to prevent dust from entering into the pump together with drain water and thereby prevent failure or malfunctioning of the pump.

Furthermore, by providing the drain evaporation pan with ribs having a capillary effect, it is possible to suck up drain water, allow drain water to be distributed evenly over the entire surfaces of the ribs, and thereby permit drain water to evaporate still more quickly.

What is claimed is:

1. A Stirling refrigerator comprising:

a Stirling refrigerating device including a heat absorber for absorbing heat from outside air, a heat-absorbing heat exchanger for prompting heat absorption by the heat absorber, a heat rejecter for rejecting heat to outside, and a heat-rejecting heat exchanger for prompting heat rejection by the heat rejecter, the Stirling refrigerating device cooling an interior of the refrigerator by absorbing heat through the heat absorber by a process of a reversed Stirling cycle, wherein dew prevention heat pipes are, at one end, coupled to an end surface of the heat rejecter, or to an end surface of a ring-shaped member made of a high-thermal-conductivity material and fitted around the heat rejecter, by being inserted in a plurality of small holes formed in the end surface of the heat rejecter or formed in the end surface of the ring shaped member and are, at another end, located at an open side of the refrigerator so that, as the Stirling refrigerating device is operated, waste heat rejected from the heat rejecter is transferred by way of the dew prevention heat pipes to heat the open side of the refrigerator.

2. A Stirling refrigerator comprising:

a Stirling refrigerating device including a heat absorber for absorbing heat from outside air, a heat-absorbing heat exchanger for prompting heat absorption by the heat absorber, and a heat rejecter for rejecting heat to outside, the Stirling refrigerating device cooling an interior of the refrigerator by absorbing heat through the heat absorber by a process of a reversed Stirling cycle, and a drain collection pan for collecting drain water resulting from defrosting of the heat-absorbing heat exchanger, wherein drain evaporation heat pipes are, at one end, coupled to an end surface of the heat rejecter, or to an end surface of a ring-shaped member made of a high-thermal-conductivity material and fitted around the heat rejecter, by being inserted in a plurality of small holes formed in the end surface of the heat rejecter or formed in the end surface of the ring shaped member and are, at another end, located above the drain collection pan so that, as the Stirling refrigerating device is operated, waste heat rejected from the heat rejecter is transferred by way of the drain evaporation heat pipes to heat the drain water.

3. A Stirling refrigerator as claimed in claim 2, wherein a plurality of flat-plate fins are fitted to the drain evaporation heat pipes.

4. A Stirling refrigerator as claimed in claim 3, wherein, among the plurality of flat-plate fins, those located at predetermined regular intervals are made longer than the others so as to make contact with the drain water.

5. A Stirling refrigerator as claimed in claim 3, wherein grooves having a capillary effect are formed in surfaces of the plurality of flat-plate fins.

6. A Stirling refrigerator as claimed in claim 3, wherein surfaces of the plurality of flat-plate fins are treated by blackening surface treatment.

7. A Stirling refrigerator as claimed in one of claims 2 to 6, wherein a ring-shaped member made of a material with high thermal conductivity is fitted around the heat rejecter, and in an end surface of the ring-shaped member are formed a plurality of small holes into which the drain evaporation heat pipes are, at one end, inserted so as to be coupled to the ring-shaped member.

8. A Stirling refrigerator comprising:

a Stirling refrigerating device including a heat absorber for absorbing heat from outside air, a heat-absorbing heat exchanger for prompting heat absorption by the heat absorber, a heat rejecter for rejecting heat to outside, and a heat-rejecting heat exchanger for prompting heat rejection by the heat rejecter, the Stirling refrigerating device cooling an interior of the refrigerator by absorbing heat through the heat absorber by a process of a reversed Stirling cycle, and a drain collection pan for collecting drain water resulting from defrosting of the heat-absorbing heat exchanger, wherein drain evaporation heat pipes are, at one end, coupled to an end surface of the heat rejecter, or to an end surface of a ring-shaped member made of a high-thermal-conductivity material and fitted around the heat rejecter, by being inserted in a plurality of small holes formed in the end surface of the heat rejecter or formed in the end surface of the ring shaped member and are, at another end, located inside the drain collection pan so that, as the Stirling refrigerating device is operated, waste heat rejected from the heat rejecter is transferred by way of the drain evaporation heat pipes to heat the drain water.

9. A Stirling refrigerator as claimed in claim 8, wherein a plurality of flat-plate fins are fitted to portions of the drain evaporation heat pipes located inside the drain collection pan.

10. A Stirling refrigerator as claimed in claim 8, wherein a water level detection sensor is provided inside the drain collection pan to check whether there is drain water in the drain collection pan or not so that, according to a result of detection by the water level detection sensor, an amount of air blown onto the heat-rejecting heat exchanger by an air-cooling fan is controlled.

11. A Stirling refrigerator as claimed in claim 8, wherein temperature sensors are provided at both ends of the drain evaporation heat pipes to check whether transfer of heat is taking place by way of the drain evaporation heat pipes or not so that, according to a result of detection by the temperature sensors, an amount of air blown onto the heat-rejecting heat exchanger by an air-cooling fan is controlled.

* * * * *